US007566687B2

(12) United States Patent
Zaid et al.

(10) Patent No.: US 7,566,687 B2
(45) Date of Patent: Jul. 28, 2009

(54) METHODS AND COMPOSITIONS FOR REMOVING SULFUR FROM LIQUID HYDROCARBONS

(75) Inventors: Gene H. Zaid, Sterling, KS (US); Beth Ann Wolf, Hutchinson, KS (US); Gary W. Zorn, Ellinwood, KS (US)

(73) Assignee: Jacam Chemical, LLC, Sterling, KS (US)

( * ) Notice: Subject to any disclaimer, the term of this patent is extended or adjusted under 35 U.S.C. 154(b) by 608 days.

(21) Appl. No.: 11/248,687

(22) Filed: Oct. 12, 2005

(65) Prior Publication Data

US 2006/0281638 A1 Dec. 14, 2006

Related U.S. Application Data

(63) Continuation-in-part of application No. 11/151,330, filed on Jun. 13, 2005, now abandoned.

(51) Int. Cl.
*C10M 125/20* (2006.01)
*C10M 141/06* (2006.01)

(52) U.S. Cl. ..... 508/154; 508/545; 508/556; 508/561; 508/563; 508/580; 208/47; 208/208 R; 507/241; 507/246; 507/265; 507/939; 252/389.61; 252/389.62; 252/392

(58) Field of Classification Search ..... 208/47, 208/208 R; 166/309; 252/389.61, 389.62, 252/392; 427/333; 507/241, 246, 265, 939; 508/154, 545, 556, 561, 563, 580
See application file for complete search history.

(56) References Cited

U.S. PATENT DOCUMENTS 2,995,603 A 8/1961 Hutchison
3,996,024 A 12/1976 Coon et al.
4,011,882 A 3/1977 Nivens et al.
4,131,583 A 12/1978 Boerwinkle
4,157,972 A 6/1979 Hotten
4,248,717 A 2/1981 Sharp et al.
4,290,900 A 9/1981 Sharp et al.
4,490,155 A 12/1984 Kaufman
4,499,006 A 2/1985 Valone et al.
5,019,361 A 5/1991 Hakka
5,032,318 A 7/1991 Bartlett
5,322,630 A 6/1994 Williams et al.
5,427,999 A 6/1995 Clewlow et al.
5,945,164 A * 8/1999 Zaid ..... 427/333
6,135,207 A * 10/2000 Zaid et al. ..... 166/309
6,213,214 B1 * 4/2001 Zaid et al. ..... 166/309
2003/0200697 A1 10/2003 Aradi et al.
2006/0281637 A1 12/2006 Zaid et al.

FOREIGN PATENT DOCUMENTS

EP 0256802 7/1987
EP 0798364 1/1997

* cited by examiner

*Primary Examiner*—Glenn Caldarola
*Assistant Examiner*—Prem C. Singh
(74) *Attorney, Agent, or Firm*—Hovey Williams LLP

(57) ABSTRACT

Improved desulfurization compositions are provided for removing substantial fractions of sulfur, sulfur complexes, and sulfur compounds from liquid hydrocarbons such as crude oil and fuels. The preferred compositions comprise respective quantities of an alkylphenol ethoxylate, an amine, and an alkali metal nitrite. The compositions may be contacted with liquid hydrocarbons to achieve high levels of desulfurization.

8 Claims, 1 Drawing Sheet

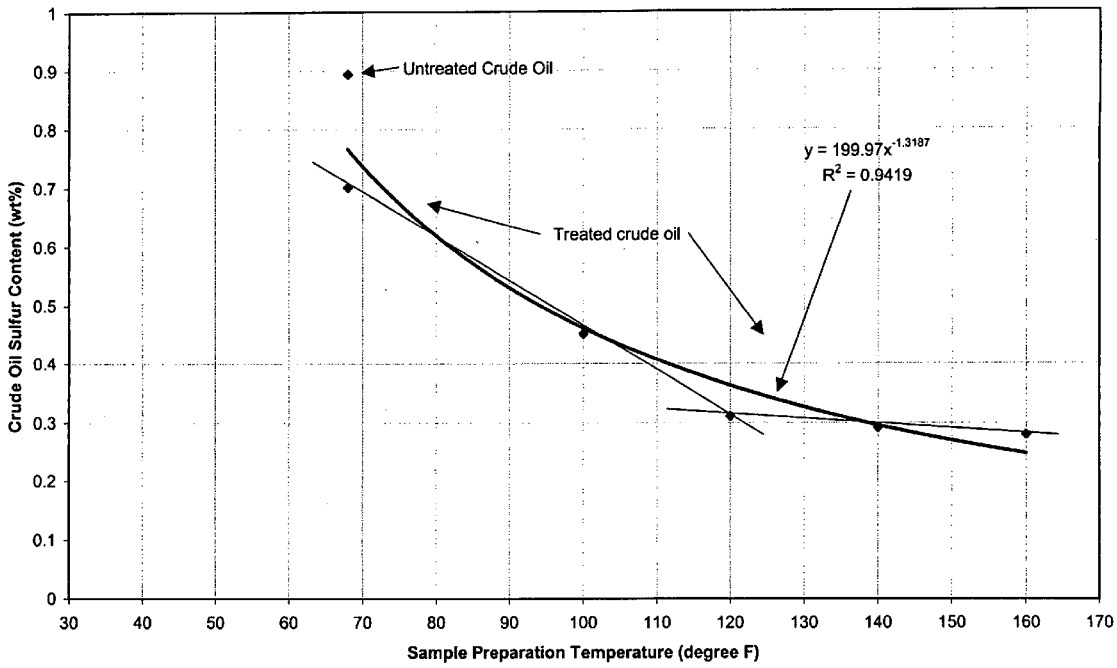
FIGURE

METHODS AND COMPOSITIONS FOR REMOVING SULFUR FROM LIQUID HYDROCARBONS

CROSS REFERENCE TO RELATED APPLICATION

This is a continuation-in-part of identically titled application Ser. No. 11/151,330 filed Jun. 13, 2005 now abandoned.

BACKGROUND OF THE INVENTION

1. Field of the Invention

The present invention is broadly concerned with desulfurization of liquid hydrocarbons such as crude oil, fuels and derivatives thereof. More particularly, the invention is concerned with compositions which can be directly contacted with liquid hydrocarbons to effect substantial desulfurization thereof, as well as methods of preparing and using the compositions. The compositions of the invention preferably are made up of solid or liquid blends including therein an alkylphenol ethoxylate, an amine, and a nitrite.

2. Description of the Prior Art

The concentration of sulfur in crude oil is typically between 0.05 and 5.0% (by weight), although values as high as 13.95% have been reported. In general, the distribution of sulfur in crude oil is such that the proportion of sulfur increases along with the boiling point of the distillate fraction. As a result, the higher the boiling range of the fuel the higher the sulfur content will tend to be. For example, a middle-distillate-range fraction, e.g., diesel fuel, will typically have a higher sulfur content than the lower-boiling-range gasoline fraction. Upon combustion, the sulfur in fuels can contribute to air pollution in the form of particulate material and acidic gases, such as sulfur dioxide. To reduce sulfur-related air pollution, the level of sulfur in fuels is regulated, and to meet these regulations sulfur must be removed from fuels during the refining process.

Refineries remove organic sulfur from crude oil-derived fuels by hydrodesulfurization (HDS). HDS is a catalytic process that converts organic sulfur to hydrogen sulfide gas by reacting crude oil fractions with hydrogen at pressures between 150 and 3,000 lb/in$^2$ and temperatures between 290 and 455° C., depending upon the feed and level of desulfurization required. Organic sulfur compounds in the lower-boiling fractions of petroleum, e.g., the gasoline range, are mainly thiols, sulfides and thiophenes, which are readily removed by HDS. However, middle-distillate fractions, e.g., the diesel and fuel oil range, contain significant amounts of benzothiophenes and dibenzothiophenes (DBTs), which are considerably more difficult to remove by HDS. Among the most refractory of these compounds are DBTs with substitutions adjacent to the sulfur moiety. Compounds of this type are referred to as sterically hindered compounds because the substitutions are believed to sterically hinder access of the sulfur atom to the catalyst surface. Due to their resistance to HDS, sterically hindered compounds represent a significant barrier to reaching very low sulfur levels in middle- and heavy-distillate-range fuels. The high cost and inherent chemical limitations associated with HDS make alternatives to this technology of interest to the petroleum industry. Moreover, current trends toward stricter regulations on the content of sulfur in fuels provide incentive for the continued search for improved desulfurization processes.

Biodesulfurization has been studied as an alternative to HDS for the removal of organic sulfur from fuels. The use of hydrocarbon degradation pathways that attached DBT were unsuccessful because these systems relied on the oxidation and mineralization of the carbon skeleton instead of on sulfur removal and therefore significantly reduced the fuel value of the desulfurized end product. More recently, bacteria that desulfurize DBT and a variety of other organic sulfur compounds typically found in petroleum oils via a sulfur selective oxidative pathway that does not remove carbon have been isolated. This pathway involves the sequential oxidation of the sulfur moiety followed by cleavage of the carbon sulfur bonds.

Despite all of these well-known desulfurization efforts, there still exists a need for easy and cost-effective desulfurization of liquid hydrocarbons, using readily available components and a simplified removal mechanism.

SUMMARY OF THE INVENTION

The present invention overcomes the problems outlined above and provides compositions effective for desulfurization of liquid hydrocarbons. As used herein, desulfurization or removal of sulfur from hydrocarbons refers to the removal of all types of sulfur and sulfur-bearing species, e.g., elemental sulfur, sulfur complexes and the full gamut of sulfur compounds found in hydrocarbons such as mercaptans and thiophenes.

Broadly speaking, these compositions comprise (and preferably consist essentially of) an alkylphenol ethoxylate and a nitrite, or an amine and a nitrite. For best results, a 3-component composition is used made up of an alkylphenol ethoxylate, a nitrite, and an amine. For reasons of cost and availability, it is especially preferred to use a nonylphenol (4-120 mole) ethoxylate, a fatty acid diamine, and sodium nitrite in the compositions. The compositions may be prepared as solids (e.g., pellets, balls, sticks, or powders), or alternately as aqueous dispersions.

In use, the compositions of the invention are simply contacted with a liquid hydrocarbon by any type of mixing operation (e.g., manual or mechanical agitation, or ultrasound treatment), in order to assure adequate sulfur removal. This can be achieved by deposit of the compositions directly into the annulus or producing zone of an oil well. In such a case, the compositions may be continuously directed into the well followed by a side stream of produced well fluid to insure that the compositions reach the well bottom. Alternately, the compositions can be added to a hydrocarbon during pipeline transfer, or as a prelude to or as a part of otherwise conventional refining.

The compositions and methods of the invention can commonly achieve desulfurization by removal of elemental sulfur, sulfur complexes, and sulfur-bearing compounds; levels of sulfur reduction of at least about 50%, and more preferably at least about 70%, can be obtained.

DRAWINGS

The single FIGURE is a graph summarizing a series of tests using the preferred composition of the invention for desulfurization of Alaskan Crude Oil at various temperatures.

DETAILED DESCRIPTION OF THE PREFERRED EMBODIMENT

The compositions of the invention can be prepared using a wide variety of individual ingredients selected from the aforementioned categories. As used herein, "alkyl," whether referring to individual compounds or as moieties of larger compounds, is intended to embrace both saturated and unsaturated species such as alkenyl and alkynl compounds or groups, as well as straight and branched chain compounds and species. Similarly, "aryl" is intended to embrace mono- or poly-ring compounds or moieties.

The amine component (when used) can be selected from the group consisting of primary, secondary, tertiary and quaternary mono- and polyamines and mixtures thereof. Preferred amines are selected from the group consisting of compounds of the formula $(R1)_2$—N—R—$(R3)_2$, R2 is selected from the group consisting of aryl, alkyl, cycloalkyl, arylalkyl, alkoxyalkyl and hydroxyalkyl groups, and mixtures thereof, and wherein each alkyl group or moiety is selected from the C2-C24 alkyls, R3 is selected from the group consisting of H and $N(R1)_2$ groups and mixtures thereof, where each R1 is independently selected from the group consisting of H, aryl, alkyl, cycloalkyl, arylalkyl, alkoxyalkyl and hydroxyalkyl groups, and mixtures thereof, and wherein each alkyl group or moiety is selected from the group consisting of the C2-C8 alkyls. However, the amines are most advantageously selected from the group consisting of the fatty acid diamines, and particularly C8-C24 fatty acid diamines. The most preferred amines are cocodiamine and tallowdiamine and mixtures thereof.

The alkylphenol ethoxylates useful in the invention are generally taken from the group having the following formula wherein R4 is selected from the group consisting of C8-C18 alkyl groups and substituted or unsubstituted C1-C16 alkylaryl groups, and mixtures thereof; R5 and R6 are each independently selected from the group consisting of H, C8-C18 alkyl groups and substituted or unsubstituted C1-C16 alkylaryl groups, and mixtures thereof; EO refers to ethylene oxide groups; and n ranges from 4-120.

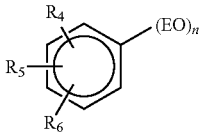

Especially preferred alkylphenol ethoxylates are the C4-C12 straight or branched chain alkyl ethoxylates, more particularly the C6-C10 species, and most preferably the nonylphenol ethoxylates. The ethoxylate moiety content of the preferred components range from about 4-120, more preferably from about 70-120, and most preferably about 100.

The nitrite component may be selected from any nitrite compound or salt that is capable of contributing nitrite groups in the compositions. However, for reasons of cost and availability, the alkali metal, alkaline earth, and ammonium nitrites are preferred, with sodium and potassium nitrites being most preferred.

The three-component compositions hereof preferably have the alkylphenol ethoxylate component present at a level of from about 0.5-65% by weight (more preferably about 30-50% by weight), the amine component present at a level of from about 0.5-50% by weight (more preferably about 5-20% by weight), and the alkali metal nitrite component present at a level of from about 0.5-70% by weight (more preferably from about 40-60% by weight). The single most preferred composition includes about 40% by weight alkylphenol ethoxylate, about 10% by weight amine, and about 50% by weight alkali metal nitrite.

Where two-component compositions are employed, containing an alkylphenol ethoxylate and a nitrite, the alkylphenol ethoxylate component should be present at a level of from about 0.5 to 90% by weight, more preferably from about 30 to 60% by weight. The nitrite component should be used at a level of from about 10 to 99.5% by weight, more preferably from about 40 to 70% by weight. Similarly, where a two-component composition comprising and amine and a nitrite are used, the nitrite should be present at a level of from about 10 to 99.5% by weight, more preferably from about 40 to 70% by weight; the amine should be used at a level of from about 0.5 to 90% by weight, more preferably from about 30 to 60% by weight.

The compositions of the invention may be prepared as solids in the form of pellets, balls or sticks, or as aqueous dispersions. In the case of solids, the ingredients can simply be blended using a high intensity mixing device to achieve substantial homogeneity, followed by forming the solid mass into discrete bodies. If desired, a minor amount of an anti-caking agent may be added to the solid product to facilitate handling; for example, up to about 5% by weight (and usually no more than about 1% by weight) of agent such as sodium silico aluminate may be used, based upon the total weight of the composition exclusive of anti-caking agent taken as 100% by weight.

Where a liquid composition is desired, the active ingredients are dispersed in water or other aqueous liquid, typically at a level of from about 1-2.5 lbs. of the solid composition ingredients per gallon of aqueous liquid. The time and intensity of mixing is variable, depending upon the nature of the desired finished product.

The compositions of the invention, whether in solid or liquid form, are capable of effecting a substantial desulfurization of liquid hydrocarbons. The hydrocarbons may be of virtually any type, for example crude oil and fuels derived from crude oil such as all grades of diesel fuel, jet fuels, and gasolines. However, it is normally desired to treat crude oil in the compositions of the invention to thereby lessen the sulfur loading on downstream refinery processes. Broadly speaking, the compositions of the invention are contacted with a selected liquid hydrocarbon in an effective amount to achieve desulfurization. The compositions should be contacted with liquid hydrocarbons at a level of from about 100-50,000 ppm (more preferably from about 250-20,000 ppm) composition per ppm of total sulfur in the liquid hydrocarbon.

In the case of crude oil, contact between the compositions of the invention and the crude can most advantageously be made simply by dropping or injecting the compositions directly into a producing well, and specifically into the annulus and/or producing zone of the well. A recycled side stream of well fluid is also injected which helps assure that the composition reaches the bottom of the well. Normally, downhole temperatures are greater than ambient surface temperatures, and it has been found that such higher temperatures accelerate the desired desulfurization. The unwanted sulfur material is separated into the water phase of the well fluid and can thus be readily handled and disposed of by conventional means.

In other treatment applications such as in well field tanks and separators, and in transmission pipelines and in refinery processing, the compositions are added to the liquid hydrocarbons with mixing, if possible, such as through the use of static mixers, agitators, or ultrasound treatment. Where possible, elevated temperatures of from about 100-180° F., more preferably from about 120-160° F., should be achieved during contact between the compositions and the liquid hydrocarbons, e.g., the liquid hydrocarbon should be heated to these levels.

It has been determined that the three active ingredients of the compositions should all be present to achieve the most significant and commercially viable desulfurization. That is, if two-component compositions are used, a degree of desulfurization is obtained, but at levels significantly below those achieved with the three-component compositions.

EXAMPLE 1

Three individual hydrocarbon liquids (Alaskan Crude Oil, Jet Fuel, and Raw Diesel Fuel) were tested using the most preferred composition of the invention, namely a water dispersion of initially solid ingredients made up of 40% by weight NP-100 (nonylphenol ethoxylate having about 100 ethoxylate moieties) 10% by weight cocodiamine, and 50% by weight sodium nitrite. In each case, the total sulfur content of the hydrocarbon was initially tested using ASTM method No. 04294. Next, 100 ml of the liquid hydrocarbon and 40 ml of liquid dispersion containing 12,500 ppm of the 3-component composition were mixed and heated to approximately 140° F. The heated mixture was then placed in a separatory funnel. The funnel was then shaken vigorously approximately 100 times, and the hydrocarbon and aqueous phases were then allowed to separate. The hydrocarbon fraction was then drawn off and again analyzed to determine the total sulfur content therein. The results of these tests are set forth in the following table.

| Liquid Hydrocarbon | Original S Content (ppm) | S Content After Treatment (ppm) | Percent S Reduction |
|---|---|---|---|
| Alaskan Crude | 9,000 | 2,700 | 70.0% |
| Jet Fuel (JP-8) | 1,452 | 224 | 84.6% |
| Raw Diesel Fuel | 7,300 | 725 | 90.1% |

EXAMPLE 2

In another set of tests, Alaska Crude Oil was tested using the most preferred 3-component composition of the invention at various oil temperatures ranging from about 65-160° F. The oil had an initial total sulfur content of 9,000 ppm and was treated with approximately 9,000 ppm of the 3-component composition. In each test, the composition was added to the oil in a separatory funnel after heating thereof, followed by agitation as described in Example 1 and settling to allow the phases to separate. The hydrocarbon fraction was then drawn off and analyzed for total sulfur content.

The FIGURE graphically illustrates the effect of oil temperature on the degree of desulfurization. At lower temperatures there was significant desulfurization but as the temperature increased to 120° F., a dramatic improvement was observed. Temperatures above 120° F. gave little further improvement.

EXAMPLE 3

Two producing oil wells in North Dakota were treated using the most preferred composition of the invention. The composition was initially prepared as a mixture of particulate solids which were then formed into approximate ¼ inch pellets. The pellets were thereafter dispersed in water at room temperature at a level of 1 pound of solid composition per gallon of water.

The first well was a horizontally drilled well producing 335 barrels of oil and 264 barrels of water per day. The well had a vertical depth of 9,000 feet and a total drilled length of 17,000 feet. The oil produced by the well had a sulfur content of 0.54%.

A total of 51 quarts of the described dispersion was introduced at a constant rate into the annulus of the well over a period of 24 hours, with a side stream of well fluid being added atop the dispersion to ensure that the dispersion reached the well bottom. The next day the oil was again tested and it was found that it exhibited a total sulfur content of 0.298%. This represented a sulfur reduction of about 238 pounds per day.

The second well at a vertical depth of 8,900 feet and a total drilled length of 13,600 feet. The well produced 320 barrels of oil and 26 barrels of water per day. The oil initially had a sulfur content of 0.508%. Fifteen quarts of the 3-component liquid dispersion were added at a constant rate over a 24 hour period to the well annulus, with a side stream of well fluid being added atop the dispersion. The next day, the oil was tested and had a total sulfur content of 0.409%, which represented a reduction in sulfur of about 93 pounds per day.

The test demonstrated that it is possible to selectively reduce sulfur content using an appropriate amount of the test composition. In particular, crude oil have a sulfur content in excess of 0.5% typically sells for $6-$7 less than oil having a sulfur content below 0.5%. Hence, the oil from this second well sold at a significantly reduced price, but the far more advantageous price of low sulfur content oil could be obtained by use of a relatively moderate amount of the composition of the invention.

While in preferred forms the compositions of the invention, in either liquid or solid form, are added as complete, multi-component compositions. However, the invention is not so limited. Specifically, the respective ingredients of either the two-component or three-component compositions may be added individually on a simultaneously or seriatum basis.

We claim:

1. A method of reducing the content of sulfur and/or sulfur-bearing compounds in a liquid hydrocarbon comprising the step of contacting the liquid hydrocarbon with an effective amount of a composition consisting essentially of respective quantities of an alkylphenol ethoxylate and a nitrite.

2. The method of claim 1, said alkylphenol ethoxylate having a C4-C12 straight or branched chain alkyl group therein.

3. The method of claim 2, said alkylphenol ethoxylate being nonylphenol ethoxylate having from about 4-120 ethoxylate moieties therein.

4. The method of claim 1, said nitrite selected from the group consisting of the alkali metal nitrites.

5. The method of claim 1, said composition being in solid form.

6. The method of claim 1, said composition being in the form of an aqueous dispersion.

7. The method of claim 6, said aqueous dispersion comprising from about 1-1.5 lbs. of said composition per gallon of aqueous liquid.

8. The method of claim 1, said composition being contacted with said liquid hydrocarbon at a level of from about 250-20,000 ppm of the composition per ppm of total sulfur in the liquid hydrocarbon.

* * * * *